US006065165A

United States Patent [19]

Delk et al.

[11] Patent Number: 6,065,165

[45] Date of Patent: May 23, 2000

[54] PRONE PATIENT APPARATUS

[75] Inventors: Dana H. Delk, N. Charleston; Barry D. Hand, Mt. Pleasant, both of S.C.

[73] Assignee: Hill-Rom, Inc., Batesville, Ind.

[21] Appl. No.: 08/918,565

[22] Filed: Aug. 22, 1997

[51] Int. Cl.[7] ..... A61G 1/00

[52] U.S. Cl. ..... 5/628; 5/625; 5/629

[58] Field of Search ..... 5/625, 628, 631, 5/632, 637, 638, 629, 81 R, 731, 735, 937, 607; 224/157; 296/20; 128/870, 871; 119/712; 297/464, 465

[56] References Cited

U.S. PATENT DOCUMENTS

| | | | |
|---|---|---|---|
| 1,667,982 | 5/1928 | Pearson . | |
| 1,799,692 | 4/1931 | Knott | 5/607 |
| 2,141,100 | 12/1938 | Warden . | |
| 2,391,928 | 1/1946 | Seib . | |
| 2,417,378 | 3/1947 | Robinson . | |
| 2,503,314 | 4/1950 | Atwood . | |
| 2,607,103 | 8/1952 | Davidson | 5/628 |
| 2,675,564 | 4/1954 | Hughes . | |
| 2,715,737 | 8/1955 | Sacks . | |
| 2,803,022 | 8/1957 | Wynkoop . | |
| 2,947,007 | 8/1960 | Oades . | |
| 2,984,842 | 5/1961 | Richards . | |
| 3,110,912 | 11/1963 | Propst | 5/628 |
| 3,111,687 | 11/1963 | Sacks . | |
| 3,151,343 | 10/1964 | McCormick . | |
| 3,302,218 | 2/1967 | Stryker . | |
| 3,449,776 | 6/1969 | Brock . | |
| 3,574,871 | 4/1971 | Greene . | |
| 3,609,778 | 10/1971 | Zeiner . | |
| 3,648,305 | 3/1972 | Ersek . | |
| 3,653,079 | 4/1972 | Bourgraf et al. . | |
| 3,689,945 | 9/1972 | Laerdal . | |
| 3,700,229 | 10/1972 | Kurokawa et al. . | |
| 3,707,734 | 1/1973 | Matthews . | |
| 3,783,863 | 1/1974 | Kliever . | |
| 3,828,377 | 8/1974 | Eary | 5/632 |
| 3,884,225 | 5/1975 | Witter . | |
| 3,890,659 | 6/1975 | Staubs . | |
| 3,926,181 | 12/1975 | Eischen | 5/632 |
| 4,024,861 | 5/1977 | Vincent . | |
| 4,030,719 | 6/1977 | Gabriele et al. . | |
| 4,033,000 | 7/1977 | Bonifay . | |
| 4,054,960 | 10/1977 | Pettit et al. . | |
| 4,183,110 | 1/1980 | Kidd et al. | 5/628 |
| 4,194,732 | 3/1980 | Liebman . | |
| 4,252,594 | 2/1981 | Cooper . | |
| 4,259,950 | 4/1981 | Klippel . | |
| 4,301,791 | 11/1981 | Franco, III . | |
| 4,347,635 | 9/1982 | Eisenhauer . | |
| 4,369,982 | 1/1983 | Hein et al. . | |
| 4,473,912 | 10/1984 | Scheidel et al. . | |
| 4,480,345 | 11/1984 | Dunn . | |
| 4,506,664 | 3/1985 | Brault . | |
| 4,566,445 | 1/1986 | Jelsma et al. . | |
| 4,579,111 | 4/1986 | Ledesma . | |
| 4,584,729 | 4/1986 | Roberts et al. . | |
| 4,596,384 | 6/1986 | Blosser | 5/735 |
| 4,601,075 | 7/1986 | Smith . | |
| 4,612,678 | 9/1986 | Fitsch . | |

(List continued on next page.)

FOREIGN PATENT DOCUMENTS

| | | |
|---|---|---|
| 2 587 898 | 4/1987 | France . |
| 2 182 570 | 5/1987 | United Kingdom . |

*Primary Examiner*—Terry Lee Melius
*Assistant Examiner*—Fredrick Conley
*Attorney, Agent, or Firm*—Bose McKinney & Evans LLP

[57] ABSTRACT

A prone patient apparatus for engaging the front of a body of a patient comprising a unitary support board having a longitudinal medial axis; a first aperture opening extending through the board and on the medial axis sized to receive a face of the patient; a second aperture opening extending through the board and spaced from the first aperture along the medial axis to expose an abdomen of the patient when the head is in the first aperture; and a third aperture opening extending through the board and spaced from the second aperture along the medial axis to expose a groan of the patient when the head is in the first aperture.

20 Claims, 2 Drawing Sheets

U.S. PATENT DOCUMENTS 4,655,206 4/1987 Moody .
4,779,858 10/1988 Saussereau .
4,827,541 5/1989 Vollman et al. .
4,840,362 6/1989 Bremer et al. ..... 5/632
4,873,710 10/1989 Lotman .
4,895,173 1/1990 Brault et al. .
4,947,418 8/1990 Barr et al. .
4,970,739 11/1990 Bradford .
5,014,374 5/1991 Williams .
5,016,268 5/1991 Lotman .
5,048,134 9/1991 Dennill et al. .
5,083,574 1/1992 Schlutow .
5,088,137 2/1992 Rose .
5,121,514 6/1992 Rosane .
5,121,756 6/1992 Koledin .
5,148,815 9/1992 Britton .
5,154,185 10/1992 Latimer et al. .
5,154,186 10/1992 Laurin et al. .
5,179,746 1/1993 Rogers .
5,190,056 3/1993 Hull .
5,211,186 5/1993 Shoemaker et al. .
5,243,639 9/1993 Johnson .
5,255,303 10/1993 DiMaio et al. .
5,263,213 11/1993 Robertson et al. .
5,274,864 1/1994 Morgan .
5,285,797 2/1994 Zeller .
5,414,883 5/1995 Fangrow, Jr. .
5,433,741 7/1995 Truglio .
5,435,323 7/1995 Rudy .
5,473,784 12/1995 Nixon et al. .
5,481,770 1/1996 Ahlsten .
5,494,051 2/1996 Schneider, Sr. .
5,499,416 3/1996 Daouk .
5,502,854 4/1996 Daouk .
5,515,869 5/1996 Powell et al. .
5,560,059 10/1996 McQueen .
5,568,662 10/1996 Gougelet .
5,577,281 11/1996 Mital et al. .
5,626,150 5/1997 Johnson et al. .
5,699,568 12/1997 Couldridge ..... 5/628

52
50
50
60
54
54
38
60
20
60
60
26
10
38
62
32
38
62
38
12
66
64
18
24
20
46
22
42
3
16
64
38
38
18
82
44
26
42
28
84
40
32
86
30
71
14
44
72
40
3
18
88
16
76
10
18
74
70
78

PRONE PATIENT APPARATUS

BACKGROUND AND SUMMARY OF THE INVENTION

The present invention relates generally to patient support apparatus and more specifically to a prone patient apparatus for engaging the front of a body of a patient.

There are many boards, stretchers, and restraint devices to restrain a supine body with the back of the body on the support structure. Most, if not all of these, are not adopted be used as a prone support device wherein the face of the body is down on the support surface. The limited number of stretchers and support systems have been used for the prone position. Two typical examples are U.S. Pat. No. 2,417,378 to Robinson and U.S. Pat. No. 4,827,541 to Vollman et al. Both of these structures include generally a pair of parallel rails having transverse structures to engage and support different portions of the body in the prone position.

The present invention is an improvement over the prior art in that it provides a prone patient apparatus including a unitary support board having longitudinal medial axis. The board includes a first aperture in the medial axis sized to receive the face of the patient. A second aperture in the board and spaced from the first apparatus along the medial axis exposes the abdomen of the patient when the head of the patient is in the first aperture. A third aperture is provided in the board and spaced from the second aperture along the medial axis to expose the groin of the patient when the head is in the first aperture. At least two pair of handles are provided along opposed longitudinal edges of the board. The handles are formed by apertures in the board along the opposed longitudinal edges of the board.

Preferably, the board includes a center planar section and a pair of longitudinal sections extending laterally in an angle to the plane of the central section. The handles are provided in the edge sections. The pair of longitudinal edge sections extend longitudinally substantially the length of the center section and terminate at a first end adjacent and intermediate to the longitudinal boundaries of the first aperture.

A plurality of pads including a plurality of pairs of fasteners affix the pads to the patient support surface. A first group of fasteners are adjacent the first opening and mate with the fasteners on a face pad. A second group of fasteners are between the first and second openings and mate with at least one chest pad. A third group of fasteners are adjacent the third opening and mate with at least one leg pad. A restraint is provided and is attached to a surface opposed the patient's surface of the board by fasteners. Preferably, these fasteners are Velcro. A pair of openings are provided adjacent the lateral edge and are separated by the second aperture. The pair of openings receive a restraint for the hips.

The first aperture is sized so that its first edge aligns the chin of a small patient and the second edge opposed the first edge aligns with the forehead of a large patient. Preferably, the first aperture is tear shaped. The second aperture is triangular with an apex adjacent the first aperture and a base adjusting the third aperture.

The size of the apertures and the ability to position the pads in different locations along the board allows adaptation of the board for different size patients.

Other objects, advantages and novel features of the present invention will become apparent from the following detailed description of the invention when considered in conjunction with the accompanying drawings.

DESCRIPTION OF THE PREFERRED EMBODIMENTS

Figures 1, 2:
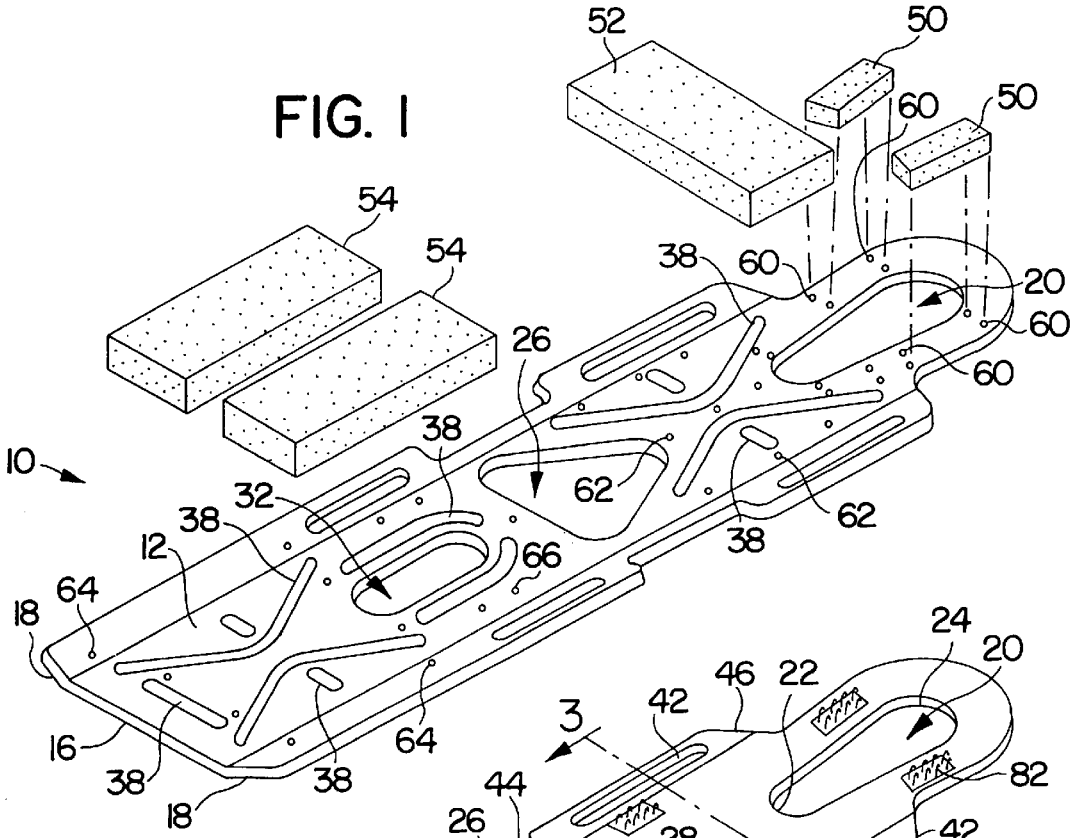
FIG. 1 is an exploded view of an embodiment of a prone patient apparatus from its patient support surface incorporating the principles of the present invention.
FIG. 2 is a perspective view of the patient prone apparatus of FIG. 1 in use.

A prone patient apparatus 10 for engaging the front of the body of a patient is shown in FIGS. 1 and 2. A unitary support board has a patient support surface 12, shown in FIG. 1 and an opposed surface 14 shown in FIG. 2. The support board includes a central planar section 16 and a pair of longitudinal edge sections 18 extending laterally at an angle to plane of the center section 16. By way of example, the edge sections 18 extend at an angle in the range of 16 to 18 degrees. The angled sections aid to keep the patient contained on the board and make it easier to roll the patient.

Extending along the medial axis of the support board is a first aperture 20 having opposed lateral edges 22 and 24 to receive the head of a patient. Also along the medial axis spaced from the first aperture 20 is a second aperture 26 having an apex 28 and a base 30 to expose the abdomen of a patient when the head is in the first aperture 20. A third aperture 32 in the board is spaced from the second aperture 26 along the medial axis and exposes the groin of the patient when the head is in the first aperture 20. Preferably, the first aperture 20 is tear-drop shaped. The edge 22 is selected to align with the chin of a smaller patient while the edge 24 is selected to align with the forehead of a larger patient. The surface 12 also includes recess 38 to add strength to the support board.

For example, the longitudinal length of the center section 16 of the support board is in the range of 62 to 63 inches. The separation between edges 22 and 24 of the first aperture 20, would be in the range of 12 inches. The separation between the apex 28 of aperture 26 and the adjacent edge 22 of the aperture 20 would be in the range of 9 to 10 inches. The distance of separation between base 30 and apex 28 of aperture 26 would be in the range of 8 to 10 inches. The separation between the base 30 of aperture 26 and aperture 32 is in the range of 3 to 5 inches. The longitudinal length of aperture 32 is in the range of 8 to 10 inches. These dimensions would expose the appropriate portions of a patient having a height in the range of 5th to 95th percentile males and females.

The edge sections 18 of the support board includes two pair of opposed handles 40 and 42 separated by a recess 44. The recess 44 provides a reduced lateral dimension which aligns basically with the waist of a patient. This allows the improved securement of the patient to the board as to be discussed below. The lateral edge sections 18 of the board extend substantially the length of the center section 16 and terminate at its first end 46 adjacent to and intermediate longitudinal boundary of the first aperture 20. The termination 46 corresponds substantially to the location of the shoulders of the patient.

As illustrated in FIG. 1, a plurality of cushions are provided and adjustably attach to the patient support surface 12. Cushions may be foam, gel or air filled. They include a pair of face cushions 50 connected by corresponding fasteners 60 adjacent to the first aperture 20. A chest cushion 52 is provided and secured to the support surface 12 by fasteners 62 in the area between the first aperture 20 and the second aperture 26. A pair of leg cushions 54 are connected by fastener 64 to the support surface 12 below the third aperture 32. Additional fasteners 66 are provided for upper leg or thigh cushions adjacent to the third aperture 32. Fasteners 60, 62, 64 and 66 include a corresponding mating element on the cushions 50, 52 and 54. Snaps or other forms of fasteners may be used.

As illustrated in FIG. 2, a plurality of straps 72, 74, 76 and 78 are secured at positions 82, 84, 86 and 88 along the non-support surface 14 of the support board. Strap 72 supports the head, strap 74 supports the chest, strap 76 supports the hips and strap 78 support the feet. The fastening of the straps to the non-support surface 14 is illustrated as using Velcro wherein the end of the strap section 41 includes a fabric which mates with a hook and loops at positions 82, 84, 86 and 88. Depending on the size of the patient or the desirability of the operator, fewer than all of the straps may be used. Although the patient in FIG. 2 is shown on an element 70, which may be another board, a cushion, sheet or other covering device, the straps 72, 74, 76 and 78 may be an integral part of the element 70 or independent thereof. Velcro may be attached directly to element 70, with straps 72, 74, 76 and 78 eliminated, if desired.

Figure 3:
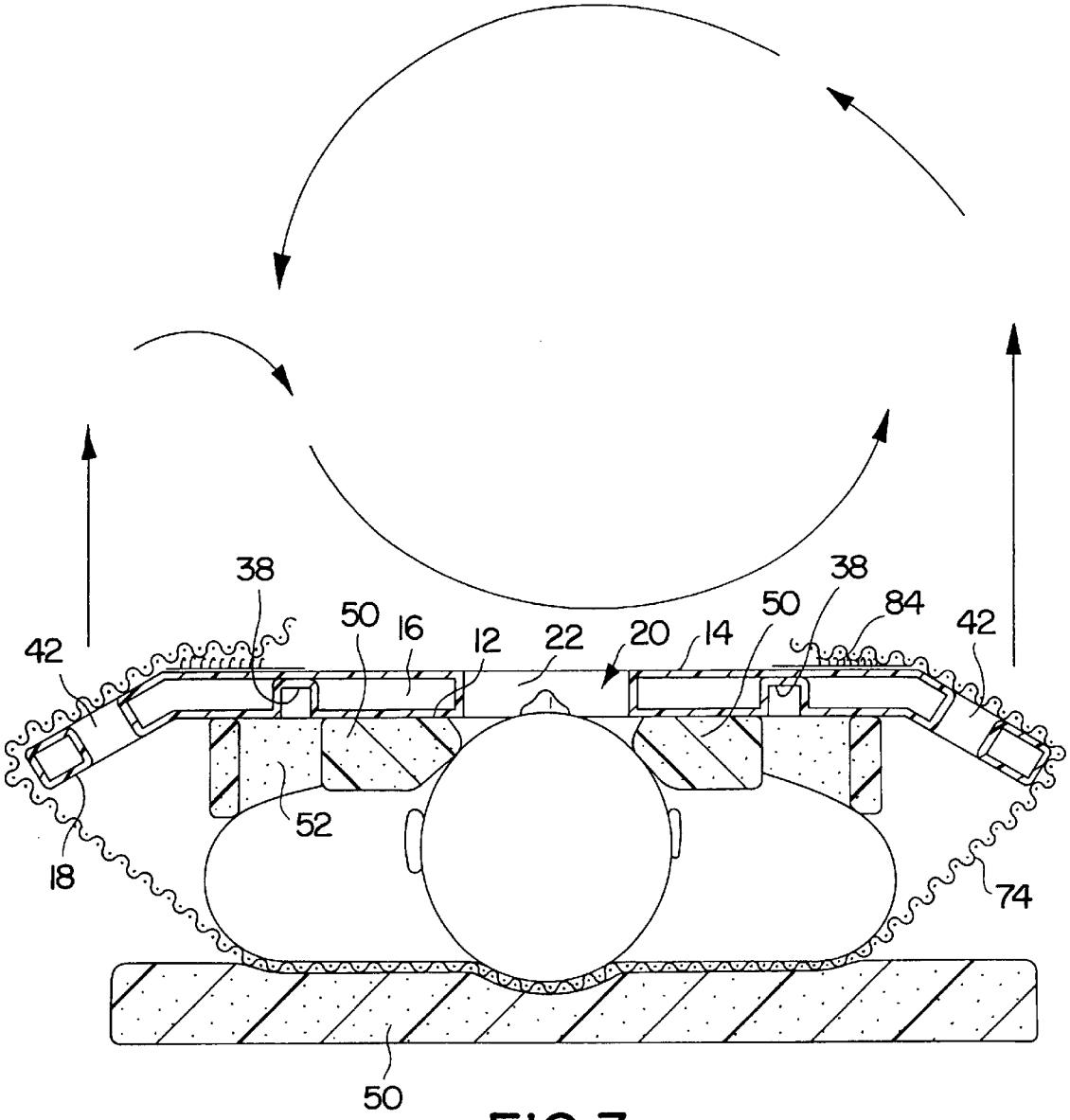
FIG. 3 is a cross-sectional view taken along FIG. 2 with the prone patient apparatus engaging a patient.

As illustrated in FIG. 3, the straps engage a patient which is laying on a mattress 90. The arrows show the movement of the prone patient apparatus 10 with the patient secured thereto to go from the prone to a supine position. As will be noted from FIG. 3, at least the nose of the patient's face and possibly the chin, would extend into the face opening 20. The cushions 50 for the face provide appropriate support and cushioning of the patient as does the illustrated chest cushion 52.

As illustrated in the cross-section of FIG. 3, the support board 10 is a hollow structure, although it may be made solid. Preferably, it is made from sheet plastic heat formed or vacuum formed. The hoolw structure may be filled with foam, if desired.

Although the support has been shown to be full-body, the principles of the present invention are also applicable to support only the upper body. Such a structure would extend from the head and terminate anywhere below aperture 26.

During installation of board 10, the edge 30 of aperture 26 is first aligned on an iliac crest (hip bone) of the patient. Then, apertures 20 and 32 accommodated 5th to 95th percentile male and female patient dimensions.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A prone patient apparatus for engaging the front of a body of a patient comprising:

a unitary support board having a longitudinal medial axis;

a first aperture opening extending through the board and on the medial axis sized to receive a face of the patient therein;

a second aperture opening extending through the board and spaced from the first aperture along the medial axis to expose an abdomen of the patient when the head is in the first aperture;

a third aperture opening extending through the board and spaced from the second aperture along the medial axis to expose a groin of the patient when the head is in the first aperture; and a plurality of cushions coupled to a patient surface of the board.

2. An apparatus according to claim 1, including at least one pair of handles along opposed longitudinal edges of the board.

3. An apparatus according to claim 2, wherein the handles include handle apertures extending through the board along the opposed longitudinal edges of the board.

4. An apparatus according to claim 2, wherein the board includes a center planar section and a pair of longitudinal edge sections extending laterally at an angle to the plane of the center section; and the handles are on the edge sections.

5. An apparatus according to claim 1, wherein the board includes a center planar section and a pair of longitudinal edge sections extending laterally at an angle to the plane of the center section.

6. An apparatus according to claim 5, wherein the first aperture has longitudinally extending boundary edges and wherein the pair of longitudinal edge sections extends longitudinally substantially the length of the center section and terminate at a first end adjacent to and intermediate the longitudinal boundaries of the first aperture.

7. An apparatus according to claim 1, further comprising a plurality of pairs of mating fasteners one of each pair affixed to the patient surface of the board and its mate affixed to one of the plurality of cushions.

8. An apparatus according to claim 7, wherein a first group of fasteners are adjacent the first opening with mates on at least one face cushion.

9. An apparatus according to claim 7, wherein a second group of fasteners are between the first and second openings with mates on at least one chest cushion.

10. An apparatus according to claim 7, wherein a third group of fasteners are adjacent the third opening with mates on at least one leg cushion.

11. An apparatus according to claim 1, including a strap; and a plurality of pairs of mating fasteners one of each pair affixed to a surface opposed a patient surface of the board and its mate affixed to the strap.

12. An apparatus according to claim 1, wherein the first aperture is defined by a plurality of edges and is sized so that a first side edge aligns with a chin of a small patient and a second side edge, opposed to the first side edge, aligns with a forehead of a large patient when such patients are located on said support board.

13. An apparatus according to claim 12, wherein the first aperture is tear drop shaped.

14. An apparatus according to claim 1, wherein the first aperture is tear drop shaped.

15. An apparatus according to claim 1, wherein the second aperture is triangular with an apex adjacent the first aperture and a base adjacent the third aperture.

16. A prone patient apparatus for engaging a front of a body of a patient comprising:

a support board having a longitudinal medial axis;

a first tear drop shaped aperture opening extending through the board and on the medial axis sized to receive a face of the patient; and a second triangular aperture opening extending through the board and spaced from the first aperture along the medial axis to expose an abdomen of the patient when the head is in the first apertures; and a plurality of cushions adjustably affixed to different positions on a patient surface of the board.

17. An apparatus according to claim 16, wherein the second aperture has an apex adjacent the first aperture.

18. An apparatus according to claim 16, further comprising a third aperture opening extending through the board and spaced from the second aperture along the medial axis to expose a groin of the patient when the head is in the first aperture.

19. An apparatus according to claim 16, wherein a first group of fasteners are adjacent the first aperture with mates on at least one face cushion.

20. An apparatus according to claim 19, wherein a second group of fasteners are between the first and second apertures with mates on at least one chest cushion.

* * * * *